United States Patent [19]

Eichweber

[11] 4,004,487

[45] Jan. 25, 1977

[54] MISSILE FIRE-CONTROL SYSTEM AND METHOD

[76] Inventor: Kurt Eichweber, Holsteiner Chaussee 73-81, 2 Hamburg 61, Germany

[22] Filed: Mar. 6, 1975

[21] Appl. No.: 555,940

[30] Foreign Application Priority Data

Mar. 12, 1974 Germany ..... 2411790

[52] U.S. Cl. ..... 89/1.815; 89/41 L; 89/41 TV; 244/3.15; 244/3.27

[51] Int. Cl.[2] ..... F41F 3/04

[58] Field of Search ..... 89/41 L, 41 TV, 1.815; 102/49.5; 244/3.14, 3.15, 3.27

[56] References Cited

UNITED STATES PATENTS

| | | | |
|---|---|---|---|
| 2,807,194 | 9/1957 | Cammin-Christy | 89/1.815 |
| 3,124,072 | 3/1964 | Herrmann | 102/49.5 |
| 3,415,465 | 12/1968 | Bedford | 244/3.14 |
| 3,715,953 | 2/1973 | Allan | 89/41 TV |
| 3,721,410 | 3/1973 | Anspacher | 244/3.14 |
| 3,962,537 | 6/1976 | Kearns et al. | 244/3.14 |

*Primary Examiner*—Stephen C. Bentley
*Attorney, Agent, or Firm*—Prutzman, Hayes, Kalb & Chilton

[57] ABSTRACT

A surface-to-surface missile fire control system employing a pilot projectile fired into a predetermined indirect ballistic trajectory monitored by a fire-control station to determine its actual trajectory and actual coordinates of impact and wherein the pilot projectile has a camera for transmitting a target area picture to the fire-control station during its relatively steep descent. A pilot projectile laser directs a laser beam onto the target area surface to show the prospective impact point of the pilot projectile in a target area picture displayed at the fire-control station and a geographic position marking selector is manually operated to pick from the target area display and automatically enter into a fire-control computer the relative geographic coordinates of the projectile impact point and a selected target shown in the display, and the fire-control computer automatically calculates the coordinates of each selected target and aims a live projectile to the selected target in accordance with its calculated coordinates and the actual trajectory of the pilot projectile.

25 Claims, 5 Drawing Figures

MISSILE FIRE-CONTROL SYSTEM AND METHOD

BACKGROUND AND SUMMARY OF THE INVENTION

A successful defense of a country depends preponderantly upon an efficient defense against enemy tanks. It is therefore very valuable to the defense of a country to be able to accurately combat tanks, and in particular large tank units, while they are still at a considerably distance from and before their entry into the direct combat zone. A weapon system having that capacity is not presently available, and combat using directly aimed or guided missiles is presently possible only at relatively short range within which the enemy tanks can return the fire. At a greater range, low angle artillery fire can be used but such artillery fire has relatively low efficiency. Airborne launching bases, for example, planes and helicopters, can be employed but such airborne launching bases are expensive and easily repulsed by anti-aircraft.

The primary purpose of the present invention is to provide a new and useful fire-control system and method having notable utility in combatting, for example but not exclusively, tanks and tank units, and providing for accurately aiming and directing missiles at a relatively long range against single targets, the relatively long range available with the present invention constituting a multiple of the maximum range possible with conventional similarly accurate weapon systems and methods and makes it possible to undertake an optimum early and efficient attack against enemy forces with a minimum of risk to material and personnel.

The present invention permits initiating combat with missiles against movable targets which are not visually observable from the missile launching site and using projectiles which are fired to the target area with directable launching devices preferably by firing the projectiles into a predetermined indirect ballistic trajectory.

Surface targets against which the fire-control system and method of the present invention are useful include movable ground targets, such as tanks and rocket-launching sites, stationary ground targets, and surface targets at sea, etc. The missile launching sites are surface based and are preferably portable and for example vehicular mounted. By an indirect ballistic trajectory, it is meant as is known, the relatively higher trajectory of the available low and high missile trajectories for a particular target range.

Firing a missile to hit a target is improved in accordance with the present invention by firing at least one pilot projectile into an indirect ballistic trajectory to the target area and therefore into relative close proximity with the target, taking pictures of the target area with the pilot projectile during its steep descent by means of suitable optical receiving and transmitting means, transmitting the target area picture to the remote launching and/or fire-control sites, and determining from the target area picture displayed at the remote site accurate aiming data for accurately aiming succeeding combat projectiles.

Obtaining a target area picture using reconnaissance aircraft for the purpose of directing fire is known as such. However, aircraft such as manned or unmanned reconnaissance planes, have always been special purpose aircraft which are expensive and vulnerable. It is an essential feature of the present invention to use a pilot projectile which is fired into a ballistic trajectory into a presumed target area, for instance, a previously reconnoitered target area, so that the pilot projectile can be used to directly determine the effectiveness of the existing fire-control data in directing the projectile and how the fire-control data should be corrected or modified for the succeeding projectiles for hitting single targets observed in the picture transmitted from the pilot projectile. In addition, a pilot projectile of the type described presents a considerably less expensive and essentially invulnerable reconnaissance medium in comparison to the usual method manned or unmanned reconnaissance aircraft with their tactical flying profiles.

A TV camera is used in the pilot projectile as the optical receiver for directly scanning the target area. Where there is poor visibility and/or reduced ambient light, a suitable low intensity camera and/or a thermal or infrared camera may be used, in combination with laser target area lighting, if desired. Since the target area picture is employed for obtaining target identification and target coordinates, the picture definition and quality can be relatively low and a comparatively simple and inexpensive picture receiver may be used in the pilot projectile. Likewise, a simple transmitter and narrow transmission channel width are sufficient for target area picture transmission, the target area picture being preferably transmitted via radio to facilitate firing the projectiles at the desired relatively long range.

Further accessories for assisting in producing the desired target area picture may include means for retarding the descent of the pilot projectile, for example aerodynamic braking, for lengthening the pilot projectile time over the target area, means for marking the projectile impact point in the target area picture with a laser beam or the like emitted from the pilot projectile, and, most importantly, means for exactly determining the actual ballistic trajectory of the pilot projectile with suitable trajectory-monitoring equipment at the launching site which may be active (e.g., radar) or passive (e.g., aimed laser monitoring, fixing the pilot projectile position with pilot projectile transmissions, etc.).

A further and particularly preferable feature of the present invention is the employment of live or combat projectiles having an automatic homing and steering device effective during the steep descent of their ballistic trajectory to automatically steer the live projectile to the target. This will improve the accuracy of the projectile and permit the projectile to be fired very effectively at great distances. While up to now the use of such automatic homing and steering devices in projectiles has been limited to relatively short range projectiles where a target determination can be made by automatic means at the launching site, the present invention makes it possible through the use of the target area picture transmitted from the pilot projectile, to establish the ballistic trajectory of the succeeding live projectiles with sufficient precision to place the live projectiles in suitable position above a selected individual target to enable effective follow-up precision control by its automatic homing and steering device.

The present invention is also connected with the provision of a fire-control system having at least one launching station with directable launching means for the combat projectiles and a fire-control station, located at or separately from the launching station, having a computer for producing direction control signals for accurately aiming the combat projectiles. It is characteristic of the fire-control system and method of the present invention to provide at least one pilot projectile along with a number of live projectiles for being launched from the launching site, and provide a camera in the pilot projectile for receiving and transmitting to the fire-control station a target area picture and equip the fire-control station with means for receiving the target area picture and produce data and commands through the employment of the target area picture and feed them into the computer for use in directing and firing the combat projectiles. In particular a fire-control station evaluation device is provided for evaluating the target area picture. The evaluation device contains a display desk for the display of the target area picture, marking means at the desk for designating or selecting individual targets and sensors for automatically determining the relative coordinates of each selected target. Also, the display desk preferably employs an optical matching device for displaying and adjusting the target area picture in accordance with the coordinates and scale of existing cartographical representations of the target area.

According to another preferred form of execution of the present invention, a multiple projectile launching device is employed having individual adjustable launching guides, each with its own aiming drive, and the individual projectile launching systems are assembled together in the form of an interchangeable projectile magazine that can be mounted as a unit on a suitable launching base. A common plug connection provides for connecting all of the aiming drives of the projectile launching magazine with control leads from the fire-control station when the magazine is mounted on its launching base.

The projectile magazine is at least roughly aimed as a unit to roughly aim the individual projectiles of the magazine to the intended target area, and so that the individual projectile launching guides can be employed to precisely aim its projectile by relatively minor angle adjustments of the launching guide and whereby it is possible to house a large number of launching guides for the pilot and combat projectiles together in a limited space in a single magazine.

Other objects and features of the present invention will be in part obvious and in part pointed out more in detail hereinafter.

A better understanding of the invention will be obtained from the following detailed description and the accompanying drawings of an illustrative application of the invention.

DESCRIPTION OF THE PREFERRED EMBODIMENT

Figure 1:
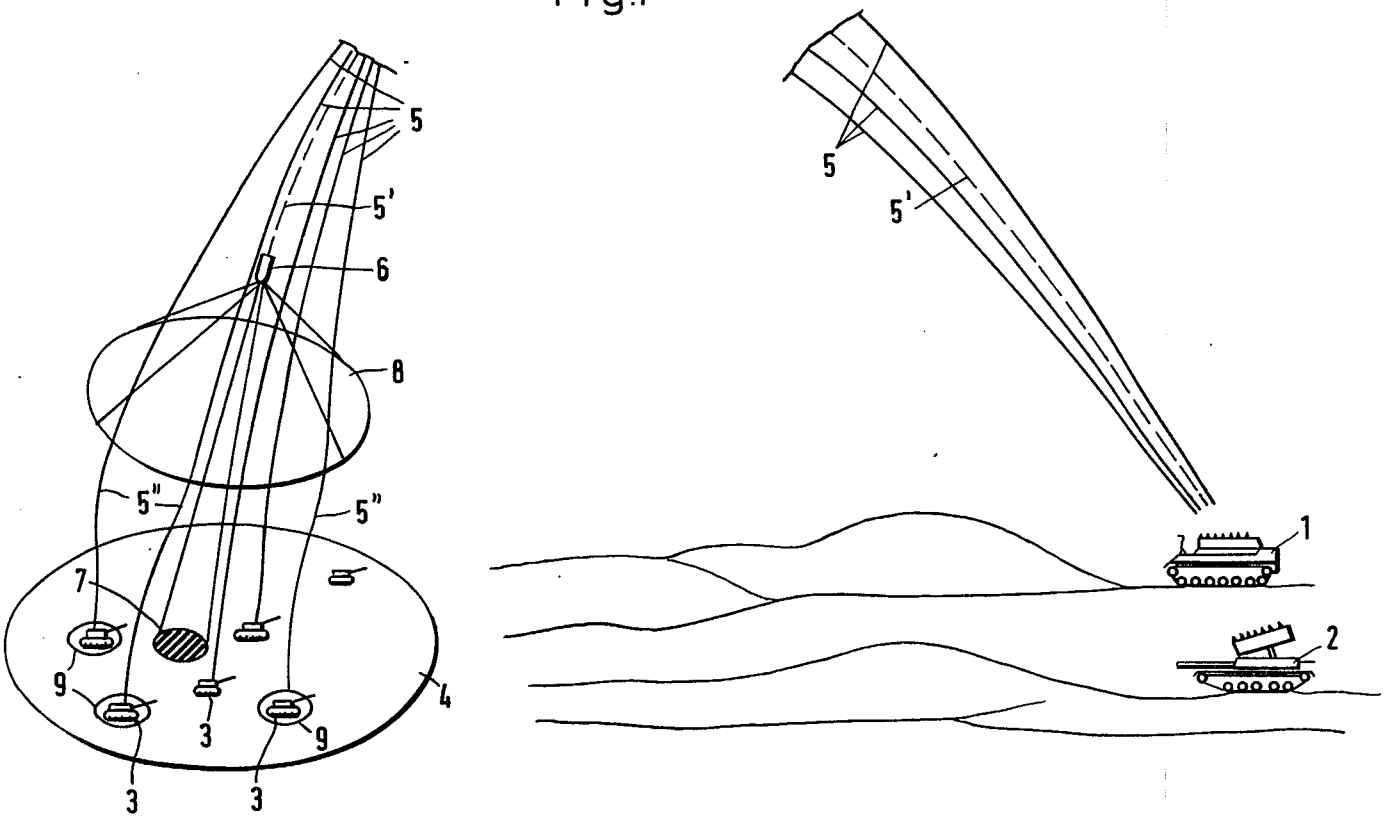
FIG. 1 is a generally diagrammatic representation of a combat action employing an embodiment of a missile fire-control system and method of the present invention.

Referring to FIG. 1, there is shown an enemy target area 4 with a number of individual enemy targets 3, e.g. tanks, the presence of which in the target area 4 is not directly visible, but is known or assumed. The target area 4 may, for example, be outside the range of conventional open tank combat and, for instance, be 15 to 20 kilometers away. In accordance with the present invention, an effective early attack against the enemy targets is adapted to be undertaken using projectiles fired to the target area 4 via indirect ballistic trajectories 5 from launching vehicles 1, 2. The projectiles employed may be without, but preferably have their own propulsion means such as conventional rocket motors. At least the first projectile fired is a pilot or reconnaissance projectile 6 (FIG. 3), i.e., it contains instead of or in addition to an explosive charge, a suitable camera 24 for receiving and transmitting a picture of the target area. The pilot projectile 6 during the nearly vertical descent portion of its trajectory receives and transmits a picture of the target area to the fire-control vehicle 1 which is suitably equipped with a suitable receiver for receiving the target area picture. In addition, the fire-control vehicle 1 is equipped with suitable trajectory-monitoring means (e.g., radar, laser monitor, etc.) which determines the actual trajectory of the projectile, including the actual position of the pilot projectile 6 during the time its camera 24 is taking and transmitting the target area picture to the fire-control vehicle 1. The picture "seen" by the pilot projectile 6 is not only shown in the fire-control vehicle 1, but is shown there with definite coordinates and is stored for further use as desired.

In order to increase the available time for the target area picture transmission, the pilot projectile 6 is preferably suitably slowed during its descent, e.g., with aerodynamic brakes. Also, a lighting unit, e.g., a laser 26, is provided in the pilot projectile 6 and beamed forwardly in its direction 28 of flight or trajectory to mark the impact point 7 of the pilot projectile with a light spot which will appear in the target area picture displayed at the fire-control station.

By coordinating the transmitted picture of the target area with the measured pilot projectile trajectory and the impact spot 7 appearing in the transmitted picture, the following can be provided at the fire-control vehicle. First, it can be readily visually determined whether, in fact, there are any visual targets in the transmitted target area picture. Secondly, the distance of each visual target from the impact point can be determined and the corresponding correction or adjustment of the fire-control direction can be calculated and individual targets appearing in the picture can be selected and individual adjustment of the combat projectile launching guides can be established so that the combat projectiles can be fired into indirect trajectories 5′ similar to that of the pilot projectile 6, but which are modified to accurately direct the combat projectiles to the individual targets 3 or at least into close proximity with the individual targets so that during the last part 5″ of their descent to the individual targets, the targets are within the range 9 of the projectile automatic homing and steering device which will then automatically direct the projectile to the target.

Accordingly, a weapon system is provided having a very high degree of accuracy in hitting individual targets outside the range of direct artillery shelling and conventional automatic target homing and remote guidance systems.

According to the special requirements of each target situation and the progression of combat, additional pilot projectiles 6 can be launched as desired, either at the same time with the live projectiles (i.e., explosive bearing projectiles) or otherwise, and perhaps in a higher trajectory than the live projectiles to provide for observing the impact of the live projectiles through the target area picture transmitted to the fire-control station. Also, the descent of the succeeding pilot projectiles can be more significantly retarded with aerodynamic braking to provide a substantially greater on-target time interval for ensuring display of the live projectile impact.

Figure 2:
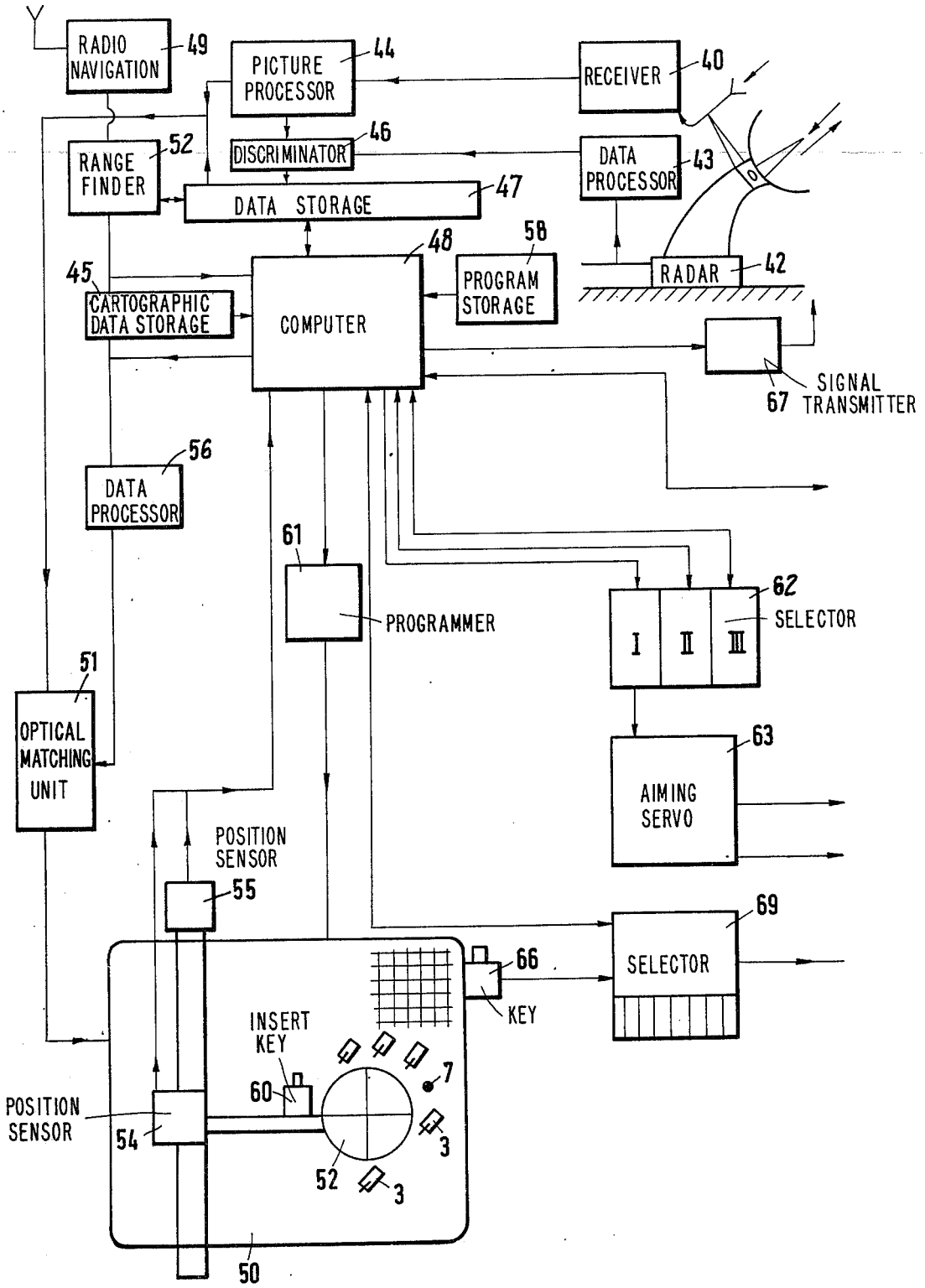
FIG. 2 is a generally block diagram representation of a fire-control station of the missile fire control system.
Figure 3:
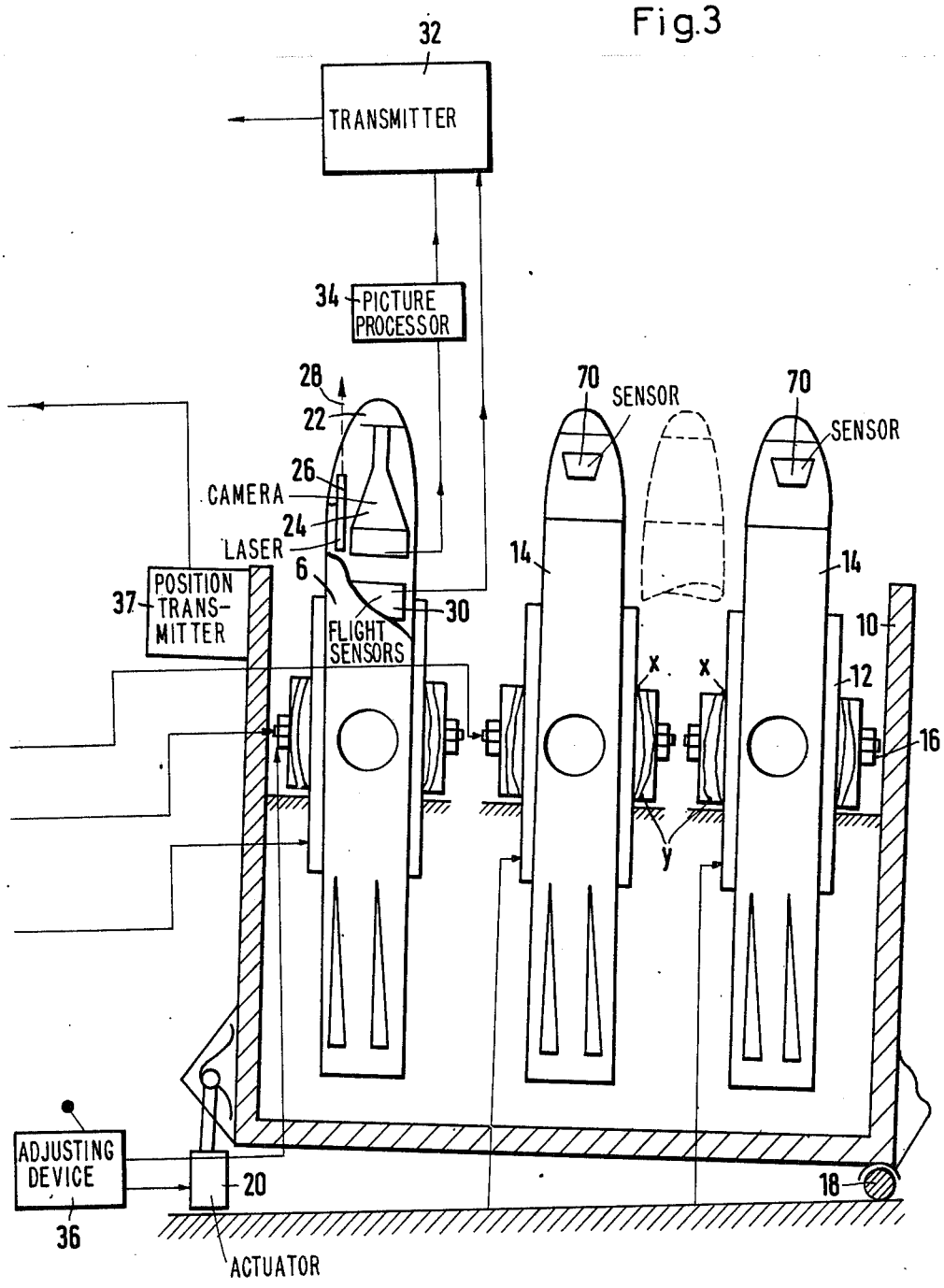
FIG. 3 is a generally diagrammatic elevation section view representation of a multiple projectile magazine of the missile fire-control system.
Figure 4:
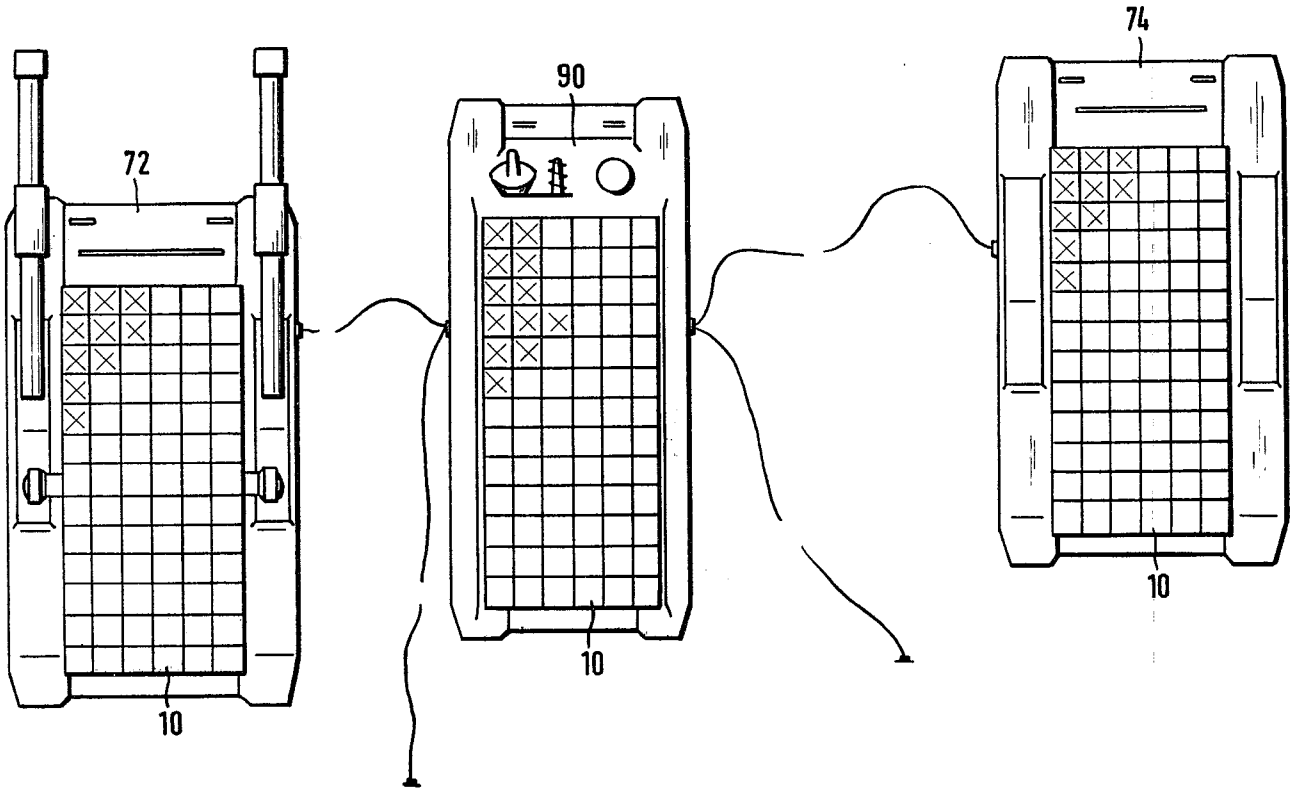
FIG. 4 is a generally diagrammatic plan view representation of three vehicular projectile launching bases of the missile fire-control system.

Referring to FIGS. 2 and 3, FIG. 2 shows the picture receiving, displaying and evaluation units and the computation and storage units, and FIG. 3 shows a projectile magazine 10 for storing and launching the projectiles 6, 14 and which may be provided either at the launching site or remotely thereof. FIG. 3 shows in particular a container like launching magazine 10 having a number of substantially identical launching guides 12 for projectiles of the same size, including live or combat projectiles 14 and at least one pilot projectile 6. Each launching guide 12 is adjustable, independently of the other guides by means of suitable guide adjusting motors or other precision adjusting devices 16, in the X and Y directions for precise angular adjustment of the elevation and azimuth of the direction of fire. In addition, the launching magazine 10 as a unit is at least roughly adjustable for instance by the provision of a magazine pivot bearing 18 and a hydraulic lifting or actuating device 20, and also by positioning and tilting its supporting vehicle. Due to the rough direction setting provided by the launching base, the individual launching guides 12 need only be finely adjusted, thereby enabling the projectiles 6, 14 to be packed with a relatively high density, for instance, in a checkerboard-like manner and alongside each other as shown diagrammatically in FIG. 4. Suitable angular position sensors (not shown) are provided to register the actual angular position of the magazine 10 in relation to three established axes and a position transmitter 37 is provided for transmitting suitable angular position signals to a fire-control station computer 48 (FIG. 2).

Referring specifically to FIG. 3, the pilot projectile 6 has a transparent nose cone or cover 22 and a suitable camera 24 shown in the shape of a TV camera, e.g., having a Reticon tube or the like, and which for particular lighting and visibility conditions (e.g., light, dusk, fog), may be a thermal camera, infrared camera, or suitable low light intensity camera. In addition, a laser 26 is provided for emitting a light beam in the forward or flight direction 28 of the projectile, and there may be provided additional flight sensors 30, in particular for the determination of the height of the flight of the projectile and, if so required, for determining other flight data (acceleration, inclination of the projectile, etc.). A target area picture transmitter 32 employed in the pilot projectile but shown separately from the projectile for clarity, is connected to the camera 24 via a suitable picture processor 34 and to the flight sensors 30. An adjusting device 36 operable by hand is provided for roughly adjusting the elevation of the magazine 10 and also, if necessary, for adjusting the individual single launching guides 12 for firing the projectiles 6, 14 to the target area.

Referring to FIG. 2, the fire-control station has suitable equipment for receiving, processing and displaying the target area picture transmitted by the pilot projectile in accordance with the actual target area coordinates. The fire-control station equipment for receiving the target area picture transmission includes a receiver 40 for receiving the signals from the pilot projectile transmitter 32 and a trajectory-monitoring radar 42. A data processor 43 connected to the radar and transmission receivers determines from their data inputs the actual trajectory of the pilot projectile which is then transmitted via a data discriminator 46 and stored in a data storage device 47. Similarly, the target area picture is transmitted from the receiver 40 via a picture processor 44 to the data storage device 47. A computer 48 is connected to the storage circuit 47 to perform, in addition to its function as a fire-control computer, the function of processing the target area picture data for displaying the target area picture information in a predetermined scale and in accordance with the appropriate target area coordinates provided by a cartographic data storage unit 45.

The screen 50 of a tactical desk provides for presenting the target area picture from the picture signals transmitted to the screen 50 from the picture processor 44 by way of an optical matching unit 51 having a construction known per se, which adjusts the target area representation to a predetermined scale and to include the target area coordinates. For that purpose, the computer 48 determines the relative local coordinates of the target area through the employment, e.g., of a radio navigation unit 49, and a local range finder 52 at the fire-control station and the stored trajectory data of the pilot projectile which is also transmitted to the optical matching unit 51 via a suitable data processor 56.

A cross slide marker 52 with cross hairs can be shifted over the screen 50 of the tactical desk and the X and Y movements of the slide are converted by the position sensors 54, 55 into suitable signals which are fed to the computer 48. Alternatively, the cross hairs can be mounted on a suitable support arm linkage and the relative cross hair position measured by measuring the angles of the support arm linkage. By adjustment of the cross hairs to overly the impact point 7 of the pilot projectile, which appears as a light point in the target area picture, the coordinates of the impact point of the pilot projectile in the target area display is determined and is selectively inserted into the computer 48 by operating an appropriate insert key at the tactical desk. By a subsequent adjustment of the cross hairs to overly any of the individual targets 3 in the target area picture, its relative XY coordinates are transmitted to the computer 48 (e.g., upon operation of a mark or insert key 60) and its absolute coordinates are computed by the computer 48 and transformed into appropriate control signals for adjusting the launching guides 12 of one or more of the live projectiles, also taking into account the information from a special program storage unit 58 containing trajectory programs for the types of live projectiles used, plus, of course, the external influences on the ballistic trajectory which are gained from measuring the actual trajectory of the pilot projectile. Although the pilot and live projectiles may have different dimensions and different ballistic flight parameters or characteristics, it is preferred that they have essentially the same dimensions, etc. so that they can be fired with the same launching systems. Also, it is preferred they have the same ballistic flight parameters or characteristics so that if identically aimed and fired at a given target area with expected identical results.

The directive data from the computer 48 is fed via a selector 62 and an aiming servo unit 63 to aim certain projectiles selected by the operation of a selector 69 with a key 66 at the tactical desk. After aiming the selected projectile launching systems with the computer 48, the aimed projectiles may be fired with the launching key 66 provided at the tactical desk. The projectile firing may also be done automatically, when the correct elevation and azimuth signals are fed back from the selected projectile launching system to the computer.

The display screen 50 may either provide a live display of the target area picture sent by the pilot projectile, in which case although a relatively short target area picture display time is provided, target movements in the target area may be observed and taken into account. Alternatively, a picture may be stored in the data storage device 47 so that the picture will be available after pilot projectile impact for any desired time interval for selecting an individual target and establishing the corresponding projectile firing angle adjustments. The manner and sequence of showing the pictures may also be programmed by a programmer 61 or done selectively. The same goes for the adjustment of enlarged picture areas or over-all representations.

Thus, the individual targets visible on the screen 50 of the tactical desk are marked by means of cross hairs and, upon the operation of the insert selector switch 60, the relative coordinates of the selected target are fed into the computer for evaluation and processing and the projectile launching guides 12 are individually angularly adjusted in numerical sequence. The time for programming each target takes only a few seconds, and such that the live projectiles 14 can be rapidly aimed and launched, individually or in series, into a calculated ballistic trajectory to strike the selected target.

Each live projectile 14 contains an automatic target homing and steering device having a sensor 70, diagrammatically shown in FIG. 3, responsive for example to thermal, infrared or dipole resonance characteristics, etc. of the selected target. Also, optical means with picture correlation with a cut-out, stored in the sensor, of the picture previously transmitted by the pilot projectile may be employed in each live projectile.

Due to the automatic precise adjustment of the firing elevation and azimuth of the live projectile 14, the projectile 14 is effective, after it passes the zenith of its ballistic trajectory and during its steep descent during which it is preferably slightly retarded, in picking-up the selected target with its homing sensor 70. A second pilot projectile launched approximately at the same time as the live projectile, but possibly with a higher trajectory, may be used to transmit a picture of the target area showing the actual impact of the live projectiles, to thereby verify their effectiveness and accuracy.

The individual steps of a possible progression of combat showing the action steps of a fire-control director and the automatic steps of the fire-control system are shown in the following table:

| | Division of Roles | |
|---|---|---|
| | Action Steps of Fire-Control Director | Steps Automatically Performed By Fire-Control System |
| 1. | Take position | |
| 2. | Prepare presumable aiming determinates | |
| 3. | Fire pilot projectile | |
| 4. | | Measure trajectory of pilot projectile |
| 5. | | Take picture of target area |
| 6. | | Transmit target area picture |
| 7. | | Store target area picture at fire-control station |
| 8. | | Measure impact coordinates of pilot projectile |
| 9. | | Store impact coordinates |
| 10. | | Display target area picture at tactical desk using actual coordinates |
| 11. | Select target at tactical desk | |
| 12. | | Store selected target coordinates |
| 13. | | Aim live projectiles |
| 14. | Fire live projectiles | |
| 15. | | Ballistic trajectory flight of each live projectile fired |
| 16. | | locating target |
| 17. | | track target and steer projectile |
| 18. | | retard downward flight of projectile |
| 19. | | destroy target |
| 20. | Fire second pilot projectile | |
| 21. | | Take picture of target area (effect reconnaissance) |
| 22. | | Transmit and store target area picture of second pilot projectile |
| 23. | Cancel deleted targets from storage | |
| 24. | Select target at tactical desk | |
| 25. | Fire additional live | |

-continued

| Division of Roles | |
|---|---|
| Action Steps of Fire-Control Director | Steps Automatically Performed By Fire-Control System |
| projectiles | |

A special fire-control vehicle 90 (FIG. 4) can be used to provide a mobile, combined fire-control and launching station, and for that purpose carries the required fire-control station equipment. Also, the fire-control vehicle 90 carries a projectile magazine 10 with a number of launching guides 12 and with the individual guides 12 arranged next to each other in a plurality of rows. The entire magazine 10 is provided in container form and is easily replaced after it is spent and so that the vehicle 90 may be rapidly reloaded. The multiple projectile magazine 10, as indicated in FIG. 3, is adapted to be inclined by a hydraulic tilting device 20 to roughly set the elevation angle of the contained projectiles (and in addition the entire vehicle 90 can be moved to roughly set the azimuth and a base elevation angle of the projectiles) so that the individual launching guides 12 require only minor angular adjustment of the azimuth and elevation angles of the projectiles to provide for precise projectile aiming. The angular position of the launching magazine 10 is preferably measured automatically and fed into the computer. The number of launching guides 12 in each magazine for firing the pilot and live projectiles may, for example, be 60 to 80, where the projectile caliber is 150 mm.

Additional mobile launching vehicles (e.g., 72, 74) may be provided and connected to the fire-control vehicle 90 so that a single fire-control vehicle 90, which is a relatively expensive installation, can be used with a number of the mobile projectile launching vehicles 72, 74. The launching vehicles 72, 74, e.g., specially constructed tanks, contain similar, replaceable magazines 10 with launching guides 12, and the aiming and firing signals are transmitted from the fire-control vehicle 90, to the auxiliary launching vehicles 72, 74 either via interconnecting wires or by radio. The selector 62 contains additional steps II, III for the additional mobile launching vehicles which may be connected to a directive-signal transmission sender 67. The auxiliary launching vehicles 72, 74 may be constructed in such a way that they may also be used as conventional combat tanks and for independently firing their projectiles if desired. Replacement magazines 10 with appropriate numbers of pilot and live projectiles, may be provided relatively inexpensively by suitable transport vehicles and so that the combat capabilities of the expensive specially equipped vehicles 72, 74, 90, in particular the fire-control vehicle 90, can be fully exploited. The magazines 10 and the vehicles carrying them are preferaby suitably constructed so that the required control leads for the direction servos are automatically connected when installing the magazine 10.

Numerous modifications of the fire-control system and method of the present invention are possible. Stationary, shipborne and/or airborne launching bases may be used instead of the preferred vehicular land bases. In addition, a mixture of live projectiles with homing heads and conventional combat heads and live projectiles especially made for laying mines may be employed.

In addition to the interconnected projectile launching sites, the fire-control vehicle 90 may also transmit data to a central command and/or a central fire-control post for centrally directing and controlling the combat operation of several launching and fire-control units, positioning and coordinating them as desired, and/or for reporting the combat action to a superior command post.

A further possible modification consists in the use of a passive trajectory-monitoring device instead of radar, for monitoring the actual pilot projectile trajectory and which acts in response to signals transmitted from the pilot projectile during flight, most importantly, as the pilot projectile nears the target area, the signals being target area picture signals, or, alternatively specific locating signals transmitted by a special sender. One such modification provides for the pilot projectile to employ suitable optical reflectors which make it possible to monitor the trajectory of the pilot projectile with a laser, the reception of the laser light reflected from the pilot projectile to the launching station being used for measuring the pilot projectile trajectory.

A further modification having particular use in combatting moving targets provides for employing a so-called active picture screen with position determinators instead of cross hairs movable over the screen. An active picture screen is equipped with a matrix of contact sensors that react upon contacting the screen with e.g., a metal stylus, to indicate the coordinates of each contact point. If a moving target in the picture is touched twice in sequence and, at the same time, the time interval between the two contact points is recorded, the direction of movement and speed of the target can be automatically recorded and transmitted to the computer 48. From that information and the other information supplied to the computer 48 (e.g., including the reaction and adjusting time up to the launching instant, as well as time of flight of the projectile, etc.) the computer 48 can accurately establish the prospective coordinates of the selected target at the prospective instant of the impact of the projectile, and the computer can compute and determine the corresponding allowance to properly adjust the launching guides 12 for accurately leading the selected target.

The determination of a selected target using a moving picture taken during the flight of the pilot projectile will generally provide for attacking only one or two individual targets during the available time period. However, if approximately equidirectional movement and speed of the individual parts of the target group can be assumed, the lead determined for the initially selected target can also be used for the additional individual targets which are then touched on the screen with the manipulating stylus in a statically appearing picture.

As a result, the corrected ballistic trajectories of the live projectiles can be established to direct the live projectiles to the proximity of individual moving targets and such that any required further steering correction can be produced by the homing and steering devices employed in the live projectiles.

The apparent increase in the scale of the target area picture during the descent of the pilot projectile would provide a misleading target movement effect, and is compensated for by suitable electronic modification of the picture scale at the screen, for example by using the heighth signal of the heighth sensor transmitted by the pilot projectile to control the picture scale.

Figure 5:
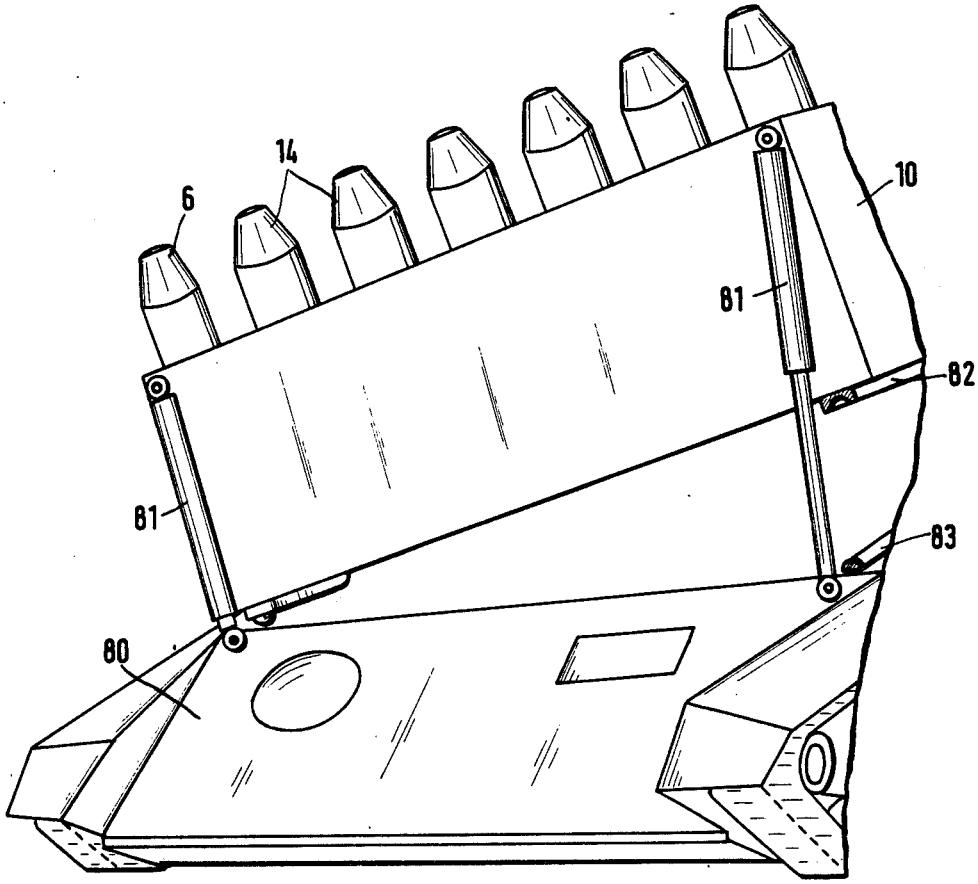
FIG. 5 is an enlarged generally diagrammatic perspective elevation view representation, partly broken away, of a vehicular projectile launching base.

FIG. 5 shows the front end of an armored full-track vehicle 80 having a launching magazine 10 of the type described with pilot and combat projectiles 6, 14, respectively. The launching magazine 10 is roughly directable by adjustment of the vehicle 80 and, in addition, the magazine 10 may be pivoted about each of two longitudinal axes like a hinge, provided by pairs of half round rails 82, 83 that match into each other and which provide detachable hinge bearings along each of the longitudinal edges of the magazine 10.

As will be apparent to persons skilled in the art, various modifications, adaptations and variations of the foregoing specific disclosure can be made without departing from the teachings of the present invention.

I claim:

1. A method of firing a combat projectile to a selected surface target comprising the steps of aiming and firing, from a launching station, a first pilot projectile into a first preset ballistic flight trajectory providing a steep descent of the pilot projectile to prospectively impact the area of a surface target, transmitting a picture of the surface target area, including the surface target and its position relative to the prospective point of impact of the pilot projectile, to a fire-control station from the pilot projectile during its descent, displaying the transmitted picture of the surface target area, including the surface target and its said position relative to said prospective impact point, at the fire-control station, and aiming a second combat projectile at the launching station into a desired second preset ballistic flight trajectory to hit the surface target in accordance with the flight trajectory of the pilot projectile and the relative position of the surface target to said prospective impact point in the target area picture displayed at the fire-control station, and firing the aimed combat projectile.

2. The method of claim 1 further comprising the step of monitoring the ballistic flight trajectory of the pilot projectile to determine its actual flight trajectory, and wherein the second combat projectile is aimed through computer coordination of the actual flight trajectory determination of the pilot projectile and a computer calculated modification of the flight trajectory in accordance with the relative position of the surface target in the target area picture displayed at the fire-control station.

3. The method of claim 1 wherein the pilot and combat projectiles have substantially the same flight trajectory characteristics.

4. The method of claim 1 further comprising the step of aerodynamically braking the pilot projectile during the transmission of the surface target area picture therefrom.

5. The method of claim 1 comprising computer computation of the desired second ballistic flight trajectory of the combat projectile in accordance with the position of the selected surface target in the displayed target area picture and computer aiming of the combat projectile in accordance with the computed desired second ballistic flight trajectory.

6. The method of claim 1 further comprising the step of firing a second pilot projectile from the launching station into a ballistic trajectory so that it is descending to the surface target area during the descent and impact of the combat projectile, transmitting from the second pilot projectile to the fire-control station during the descent of the second pilot projectile a picture of the surface target area showing the impact of the combat projectile, and displaying at the fire-control station the surface target area picture showing the combat projectile impact.

7. The method of claim 6 wherein the second pilot projectile is fired into a higher ballistic trajectory than the combat projectile.

8. The method of claim 1 further comprising sensing the selected target from the combat projectile during its descent to the surface target area and thereafter automatically steering the combat projectile to the selected target.

9. The method of claim 8 comprising the step of programming the combat projectile to automatically sense the selected target in accordance with its relative position on the surface target area picture transmitted to the fire-control station.

10. A projectile fire-control system for aiming and firing pilot and combat projectiles from a surface launching station to a distant surface target area by aiming and firing the projectiles into ballistic trajectories having a steep descent to the surface target area, comprising a fire-control station, a launching station having a plurality of projectile launching systems with respective projectiles adapted to be aimed for firing their projectiles into respective ballistic trajectories, the projectiles including a plurality of combat projectiles and at least one pilot projectile having a camera therein for transmitting a target area picture from the pilot projectile to the fire-control station during its steep descent, the fire-control station having a fire-control computer for aiming each projectile launching system for aiming the respective projectile into a ballistic trajectory to a selected target in the surface target area, means for firing the pilot projectile into a ballistic trajectory to have a steep descent to the surface target area, displaying means for receiving the target area picture transmission from the pilot projectile during its steep descent and displaying the target area picture for visually selecting any target in the target area picture, manually operable means for marking any selected target in the target area picture and feeding the relative position of the selected target in the target area picture into the fire-control computer for aiming therewith a combat projectile launching system accordingly and thereby aim its combat projectile so it can be fired into a ballistic flight trajectory to proximately impact the selected target, the pilot projectile comprising a laser for transmitting a light beam in the direction of flight of the pilot projectile for marking a light spot on the prospective impact area of the pilot projectile for being received in the target area picture transmitted to the fire-control station.

11. A projectile fire-control system for aiming and firing pilot and combat projectiles from a surface launching station at a distant surface target area by aiming and firing the projectiles into ballistic trajectories having a steep descent to the surface target area, comprising a fire-control station, a launching station having a plurality of projectile launching systems with respective projectiles adapted to be aimed for firing their projectiles into respective ballistic trajectories, the projectiles including a plurality of combat projectiles and at least one pilot projectile having a camera therein for transmitting a target area picture from the pilot projectile to the fire-control station during its steep descent showing the relative position of any surface target to the prospective point of impact of the pilot projectile the fire-control station having a fire-control computer for aiming each projectile launching system for aiming the respective projectile into a preset ballistic trajectory to a selected target in the surface target area, means for aiming and firing the pilot projectile into a first preset ballistic trajectory to have a steep descent to the surface target area, display means for receiving the target area picture transmission from the pilot projectile during its steep descent and displaying the target area picture for visually selecting any target in the target area picture, manually operable means for marking any selected target in the target area picture and feeding the relative position of the selected target in the target area picture to said prospective impact point of the pilot projectile into the fire-control computer for aiming therewith a combat projectile launching system accordingly and thereby aim its combat projectile so it can be fired into a preset ballistic flight trajectory in accordance with the flight trajectory of the pilot projectile and the said relative position of the selected target in the target area picture to said prospective impact point of the pilot projectile and thereby to aim the combat projectile to proximately impact the selected target.

12. A projectile fire-control system according to claim 11 wherein the pilot projectile has a TV type camera for transmitting the target area picture to the fire-control station.

13. A projectile fire-control system according to claim 12 wherein the TV type camera is an infrared camera, thermal camera or low light intensity camera.

14. A projectile fire-control system according to claim 11 wherein the fire-control station comprises pilot projectile trajectory monitoring means for determining the actual pilot projectile trajectory and for feeding inputting its actual trajectory into the fire-control computer, the fire-control computer being operable for aiming the combat projectile launching systems in accordance with the actual pilot projectile trajectory in coordination with the relative position of the selected target in the target area picture.

15. A projectile fire-control system according to claim 14 wherein the pilot and combat projectiles have substantially the same flight trajectory characteristics and their launching systems are substantially the same.

16. A projectile fire-control system according to claim 11 wherein the marking means comprises a marker manually adjustable over the displayed target area picture area and sensing means for determining the relative position of the marker and therefore the relative position of the point of the target area picture underlying the marker.

17. A projectile fire-control system according to claim 11 wherein the fire-control station comprises optical matching means for displaying the target area picture with coordinates and at a predetermined scale.

18. A projectile fire-control system according to claim 11 wherein the combat projectiles have automatic target homing and steering means effective during the steep descent of the combat projectile to sense the selected target and thereafter steer the projectile to the selected target.

19. A projectile fire-control system according to claim 18 wherein the automatic target homing and steering means comprises target area representation means programmable with a predetermined target area representation and comparison means for comparing, during the descent of the combat projectile, the combat projectile impact area with the programmed target area representation, the homing and steering means being operable to automatically steer the combat projectile in accordance with the relationship between the projectile impact area and the programmed target area representation.

20. A projectile fire-control system according to claim 11 wherein the plurality of projectile launching systems have individually directable projectile launching guides and collectively form a replaceable multiple projectile magazine, motor means for individually directing the launching guides for aiming the respective projectiles, and a common plug for the multiple projectile magazine for connecting the motor means of the directable launching guides of the magazine to the fire-control computer for directing each launching guide with the fire-control computer.

21. A projectile fire-control system according to claim 20 further comprising adjustment means for angularly adjusting the projectile magazine for roughly angularly adjusting the launching guides thereof.

22. A projectile fire-control system according to claim 21 further comprising magazine elevation and azimuth transmitter means operable to transmit to the fire-control computer the elevation and azimuth angles of the multiple projectile magazine.

23. A projectile fire-control system according to claim 11 wherein the marking means is operable for marking time spaced positions of a selected movable target in the target area picture representing prior actual movement thereof, and wherein the fire-control computer is operably by said time spaced positions fed thereto by the marking means for aiming a combat projectile launching system to aim a combat projectile to lead the selected target in accordance with its prior actual movement.

24. A method of firing a combat projectile to a selected surface target comprising the steps of firing, from a launching station, a first pilot projectile into a first ballistic flight trajectory providing a steep descent of the pilot projectile to prospectively impact the area of a surface target, transmitting a picture of the surface target area, including the surface target, to a fire-control station from the pilot projectile during its descent, marking the prospective impact area of the pilot projectile on the surface target area picture transmitted to the fire-control station, displaying the transmitted picture of the surface target area, including the surface target, at the fire-control station, and aiming a second combat projectile at the launching station into a desired second ballistic flight trajectory to hit the surface target in accordance with its relative position in the target area picture displayed at the fire-control station, and firing the aimed combat projectile.

25. The method of claim 24 wherein the prospective impact area of the pilot projectile is marked by a laser beam projecting from the pilot projectile onto the prospective impact area for being transmitted to the fire-control station in the surface area picture.

* * * * *